US011409229B2

(12) United States Patent
Morita

(10) Patent No.: US 11,409,229 B2
(45) **Date of Patent: *Aug. 9, 2022**

(54) IMAGE FORMING APPARATUS WHICH PREVENTS EXECUTION OF A PRINT PROCESS WHILE AN INTERLOCK WITH A COVER PORTION IS RELEASED

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/346,506

(22) Filed: Jun. 14, 2021

(65) Prior Publication Data

US 2021/0389718 A1 Dec. 16, 2021

(30) Foreign Application Priority Data

Jun. 16, 2020 (JP) ..... JP2020-103532

(51) Int. Cl.
*G03G 21/16* (2006.01)
*G03G 15/00* (2006.01)

(52) U.S. Cl.
CPC ..... *G03G 21/1647* (2013.01); *G03G 15/50* (2013.01)

(58) Field of Classification Search
CPC . G03G 21/1647; G03G 15/50; G03G 15/0886
See application file for complete search history.

(56) References Cited

U.S. PATENT DOCUMENTS

2013/0243445 A1* 9/2013 Takahira ..... G03G 15/0886 399/13
2021/0389694 A1* 12/2021 Morita ..... G03G 15/0886

FOREIGN PATENT DOCUMENTS

JP 2008191578 A 8/2008

* cited by examiner

*Primary Examiner* — Sandra Brase
(74) *Attorney, Agent, or Firm* — Alleman Hall Creasman & Tuttle LLP

(57) ABSTRACT

A control device permits execution of a print process on condition that an object sensor detects an object at a detection position. A switch mechanism, in accordance with a release operation, releases an interlock between a first displacement member and a closing operation of a cover portion. In a state where a second displacement member is located at an actuation position, a detected portion is located at the detection position. When the second displacement member is located at a retreat position, a first contact portion is not in contact with the cover portion. When the cover portion is closed, the cover portion displaces the second displacement member from a standard position to an actuation position. When the first displacement member is displaced from a first relay position to a second relay position, the first displacement member displaces the second displacement member from the standard position to the retreat position.

5 Claims, 8 Drawing Sheets

IMAGE FORMING APPARATUS WHICH PREVENTS EXECUTION OF A PRINT PROCESS WHILE AN INTERLOCK WITH A COVER PORTION IS RELEASED

INCORPORATION BY REFERENCE

This application is based upon and claims the benefit of priority from the corresponding Japanese Patent Application No. 2020-103532 filed on Jun. 16, 2020, the entire contents of which are incorporated herein by reference.

BACKGROUND

The present disclosure relates to an image forming apparatus to which a developer container is attached.

An electrophotographic image forming apparatus includes a photoconductor and a developing device, wherein an electrostatic latent image is formed on a surface of the photoconductor, and the developing device develops the electrostatic latent image. The developer is supplied from a developer container to the developing device.

The developer container is a consumable that stores the developer and is attached to an attachment portion provided in an apparatus main body. An opening communicating with the attachment portion is formed in the apparatus main body, and the developer container is replaced in a state where a cover portion that opens and closes the opening is open.

In order to prevent the developer from leaking during a replacement of the developer container, the developer container includes a shutter that is configured to open and close a feed-out opening from which the developer is fed out.

In addition, there is known an image forming apparatus that includes a mechanism configured to close the shutter in conjunction with an opening operation of the cover portion, and open the shutter in conjunction with a closing operation of the cover portion. This makes it possible to, without a special operation, prevent the developer from scattering when the cover portion is opened.

In addition, the image forming apparatus includes one or more units, such as a drum unit, a developing unit, an intermediate transfer unit, or the developer container. The unit is attached to a predetermined attachment portion provided in an apparatus main body.

The drum unit includes the photoconductor. The developing unit includes a developing roller that supplies developer to the electrostatic latent image. The intermediate transfer unit includes an intermediate transfer body to which an image is transferred from the photoconductor.

The developer container includes a storage portion, a shutter, and a stirring member, wherein the storage portion stores the developer that is supplied to the developing unit, the shutter is configured to open and close a feed-out opening from which the developer stored in the storage portion is fed out, and the stirring member stirs the developer in the storage portion.

An opening communicating with the attachment portion is formed in the apparatus main body, and the unit is attached to and detached from the attachment portion in a state where a cover portion that opens and closes the opening is open.

The unit includes a driven portion and a drive input portion, wherein the drive input portion receives an external force that drives the driven portion. The attachment portion includes a drive output portion that is engaged with the drive input portion and applies a driving force to the driven portion via the drive input portion.

The photoconductor of the drum unit, the developing roller of the developing unit, the intermediate transfer body of the intermediate transfer unit, and the shutter and the stirring member of the developer container are examples of the driven portion.

In addition, there is known an image forming apparatus that includes a mechanism configured to displace the drive output portion in conjunction with the operation of the cover portion.

For example, there is known an image forming apparatus that includes a mechanism configured to close the shutter of the developer container by interlocking the drive output portion with the opening operation of the cover portion, and open the shutter by interlocking the drive output portion with the closing operation of the cover portion.

SUMMARY

An image forming apparatus according to an aspect of the present disclosure includes an apparatus main body, a cover portion, one or more drive output portions, a first interlocking mechanism, a second interlocking mechanism, an object sensor, a second displacement member, a return elastic member, and a control device. In the apparatus main body, an attachment portion is provided and a main opening communicating with the attachment portion is formed. One or more units are attached to the attachment portion, and each of the units includes a driven portion and a drive input portion. The drive input portion receives an external force to drive the driven portion. The cover portion is supported by the apparatus main body and configured to open and close the main opening. The one or more drive output portions are provided in the apparatus main body in correspondence with the drive input portions of the units, and supported in such a way as to be displaced between a predetermined first output position and a predetermined second output position. The first interlocking mechanism is provided in the apparatus main body and includes a first displacement member supported in such a way as to be displaced between a predetermined first relay position and a predetermined second relay position. The first interlocking mechanism causes the first displacement member to be displaced to the second relay position in conjunction with an opening operation of the cover portion, and causes the first displacement member to be displaced to the first relay position in conjunction with a closing operation of the cover portion. The second interlocking mechanism is configured to cause the drive output portions to be displaced to the first output position in conjunction with a displacement of the first displacement member to the second relay position, and cause the drive output portions to be displaced to the second output position in conjunction with a displacement of the first displacement member to the first relay position. The object sensor is disposed in the apparatus main body and configured to detect an object that is located at a predetermined detection position. The second displacement member includes a first contact portion, a second contact portion, and a detected portion, and is supported in such a way as to be displaced among a standard position, an actuation position, and a retreat position in the apparatus main body. The first contact portion abuts on an butting portion formed on the cover portion when the cover portion is closed. The second contact portion abuts on the first displacement member displaced to the second relay position. The detected portion is configured to proceed to the detection position. The return elastic member is configured to apply an elastic force to the second displacement member to hold the second displacement member at the standard position. The control device is configured to permit an execution of a print process on condition that the object sensor detects the object, and prohibit the execution of the print process when the object sensor does not detect the object. The first interlocking mechanism includes a switch mechanism configured to, in accordance with a predetermined release operation, release the first displacement member from moving in conjunction with the closing operation of the cover portion, and in accordance with a predetermined enabling operation, enable the first displacement member to move in conjunction with the closing operation of the cover portion. In a state where the second displacement member is located at the standard position, the first contact portion is located at a position where the first contact portion is in contact with the abutting portion of the cover portion, and the detected portion is located outside the detection position. In a state where the second displacement member is located at the actuation position, the detected portion is located at the detection position. In a state where the second displacement member is located at the retreat position, the first contact portion is located at a position where the first contact portion is not in contact with the abutting portion of the cover portion, and the detected portion is located outside the detection position. When the cover portion is closed in the state where the second displacement member is located at the standard position, the abutting portion of the cover portion abuts on the first contact portion, and thereby displaces the second displacement member from the standard position to the actuation position. When the first displacement member is displaced to the second relay position in the state where the second displacement member is located at the standard position, the first displacement member abuts on the second contact portion and thereby displaces the second displacement member from the standard position to the retreat position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Configuration of Image Forming Apparatus 10

An image forming apparatus 10 according to an embodiment includes a print device 4 that executes a print process by an electrophotographic method. In the print process, an image is formed on a sheet 9. The sheet 9 is an image formation medium such as a sheet of paper or a sheet-like resin material.

Figure 1:
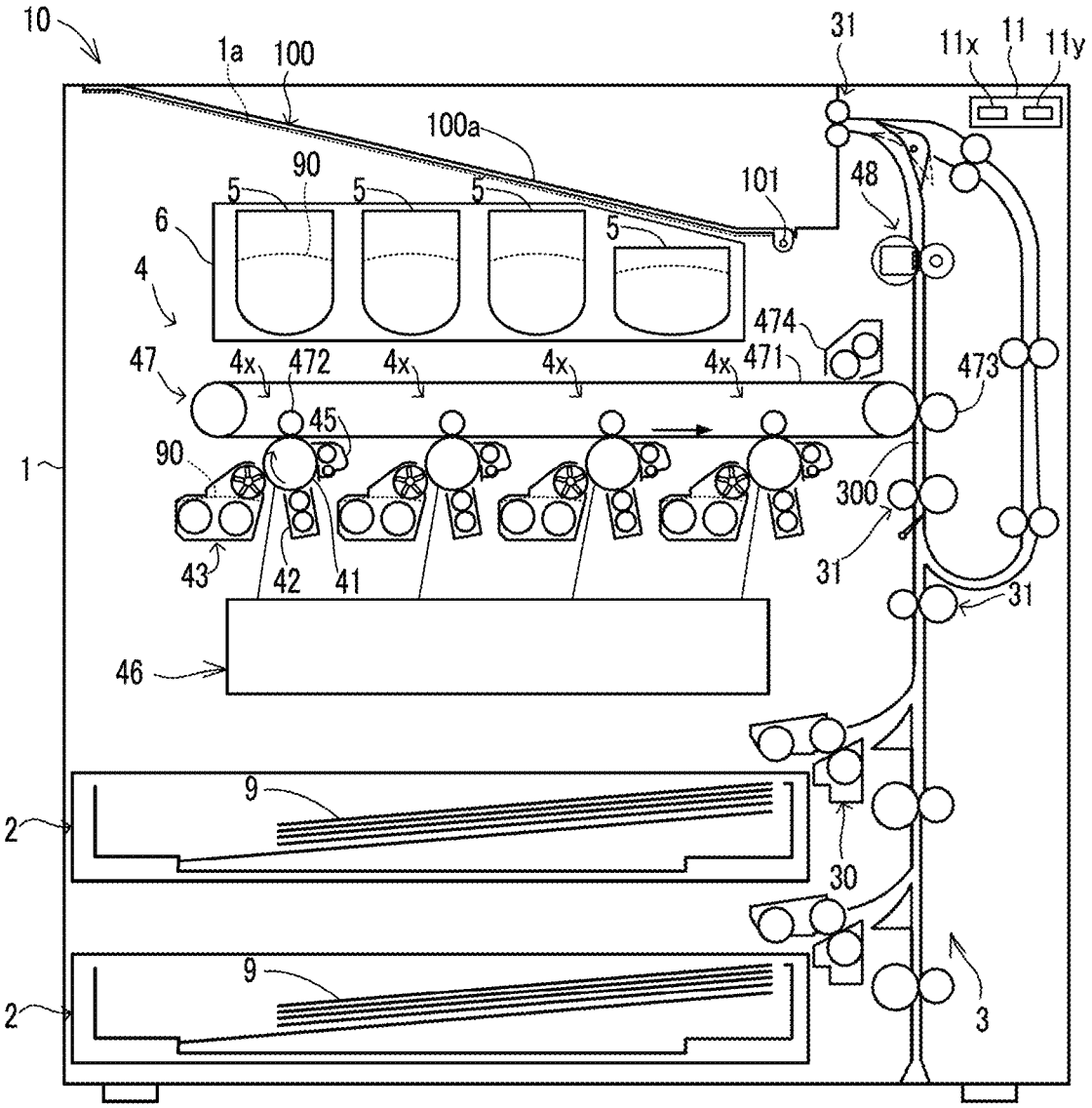
FIG. 1 is a configuration diagram of an image forming apparatus according to an embodiment.

As shown in FIG. 1, the image forming apparatus 10 includes a sheet storage portion 2, a sheet conveying device 3, and the print device 4, wherein the sheet conveying device 3 and the print device 4 are provided in an apparatus main body 1. The apparatus main body 1 is a main housing storing the print device 4.

The sheet conveying device 3 includes a sheet feed device 30 and a plurality of pairs of conveyance rollers 31 that are driven by a motor (not shown). The sheet feed device 30 feeds the sheet 9 stored in the sheet storage portion 2 to a conveyance path 300 in the apparatus main body 1.

The plurality of pairs of conveyance rollers 31 convey the sheet 9 along the conveyance path 300, and discharge the sheet 9 from an exit of the conveyance path 300 onto a discharge tray 100*a*.

The print device 4 forms an image on the sheet 9 that is conveyed along the conveyance path 300. The print device 4 includes an image creating device 4*x*, an exposure device 46, a transfer device 47, and a fixing device 48. The image creating device 4*x* includes a drum-like photoconductor 41, a charging device 42, a developing device 43, and a drum cleaning device 45.

The image forming apparatus 10 shown in FIG. 1 is a tandem-type color image forming apparatus. As a result, the print device 4 includes four image creating devices 4*x* corresponding to four colors of toner, namely, yellow, cyan, magenta, and black toner.

Furthermore, the transfer device 47 includes an intermediate transfer belt 471, four first transfer portions 472 corresponding to the four image creating devices 4*x*, a second transfer portion 473, and a belt cleaning portion 474.

In each of the image creating devices 4*x*, the photoconductor 41 rotates, and the charging device 42 electrically charges the surface of the photoconductor 41. Furthermore, the exposure device 46 writes an electrostatic latent image on the surface of the photoconductor 41. The photoconductor 41 is an example of an image carrier.

Furthermore, the developing device 43 develops the electrostatic latent image as a toner image by supplying toner 90 to the surface of the photoconductor 41. It is noted that the toner 90 is an example of granular developer.

The transfer device 47 transfers the toner image to the sheet 9 in the conveyance path 300. The first transfer device 472 transfers the toner image from the surface of the photoconductor 41 to the surface of the intermediate transfer belt 471. This allows a color toner image to be formed on the surface of the intermediate transfer belt 471.

The second transfer device 473 transfers the toner image from the intermediate transfer belt 471 to the sheet 9 in the conveyance path 300.

It is noted that in a case where the image forming apparatus 10 is a monochrome image forming apparatus, the second transfer device 473 transfers the toner image from the surface of the photoconductor 41 to the sheet 9 in the conveyance path 300.

The drum cleaning device 45 removes the residual waste toner from the surface of the photoconductor 41. The belt cleaning device 474 removes the residual waste toner from the intermediate transfer belt 471.

The fixing device 48 fixes the toner image that has been transferred to the sheet 9, to the sheet 9 by applying heat and pressure to the toner image.

The image forming apparatus 10 further includes a control device 11 configured to control the sheet conveying device 3 and the print device 4 (see FIG. 1). The control device 11 includes a processor 11*x* and a storage device 11*y*, wherein the processor 11*x* executes a computer program, and the storage device 11*y* stores the computer program. As the processor 11*x* executes the computer program, the control device 11 executes various types of data processing and controls.

The toner 90 is supplied from a toner container 5 to the developing device 43. The toner container 5 is a consumable that stores the toner 90 and is attached to the apparatus main body 1 in a detachable manner.

The image forming apparatus 10 further includes an attachment portion 6 to which the toner container 5 is attached. The toner container 5 is attached, in a detachable manner, to the attachment portion 6 provided in the apparatus main body 1. A main opening 1*a* communicating with the attachment portion 6 is formed in the apparatus main body 1.

In the present embodiment, the main opening 1*a* is formed in an upper portion of the apparatus main body 1. The image forming apparatus 10 further includes a cover portion 100 configured to close the main opening 1*a*. The cover portion 100 is configured to open and close the main opening 1*a*. In a state where the cover portion 100 is open, the toner container 5 is replaced.

The cover portion 100 is supported by the apparatus main body 1 such that the cover portion 100 can pivot vertically. A rotary shaft 101 of the cover portion 100 is rotatably supported by the apparatus main body 1. In the present embodiment, the cover portion 100 forms the discharge tray 100*a*.

Figure 8:
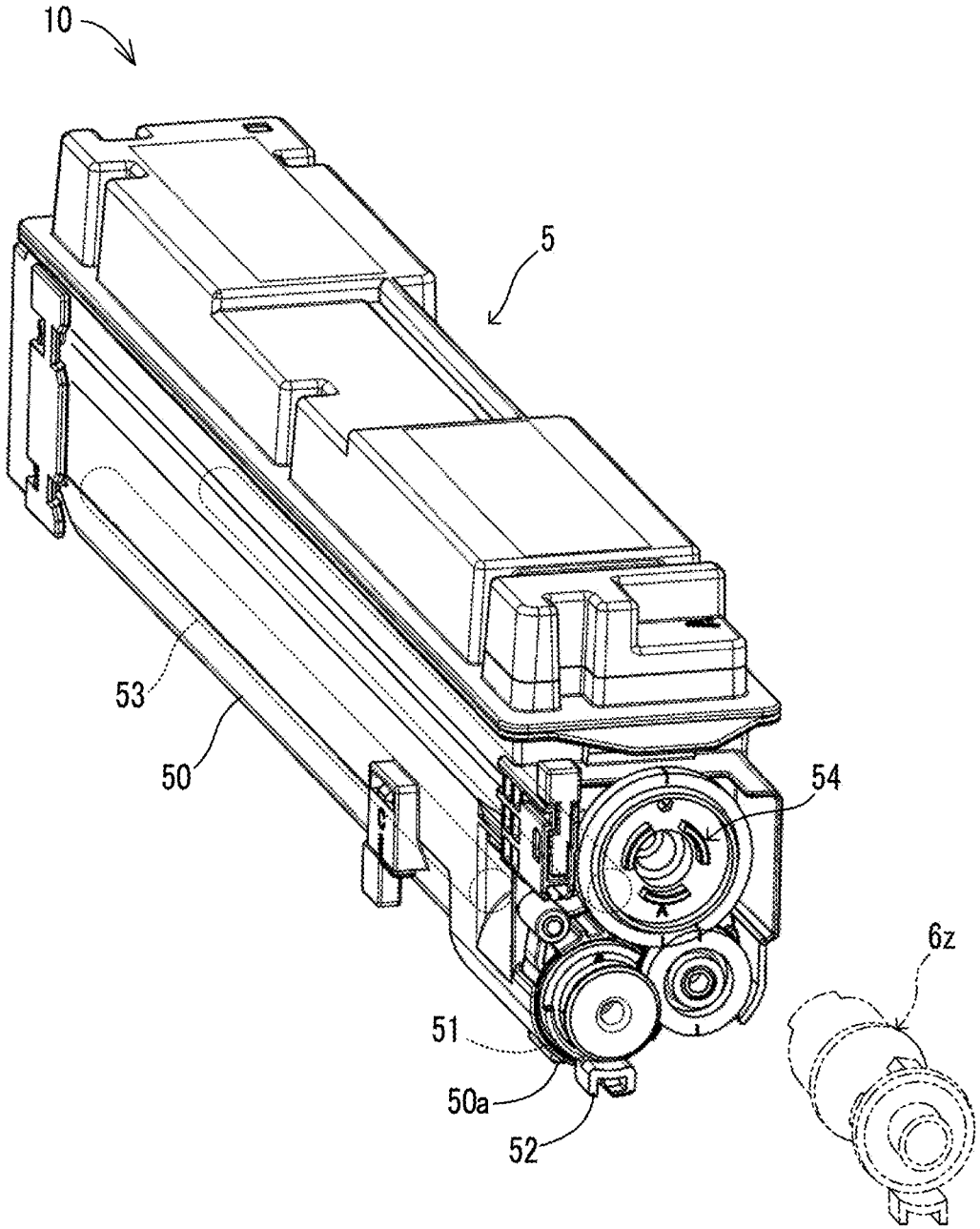
FIG. 8 is a perspective diagram of a developer container.

As shown in FIG. 8, the toner container 5 includes a storage portion 50, a shutter 51, and a shutter input portion 52. The storage portion 50 is a case in which the toner 90 is stored. The shutter 51 is a member that closes a feed-out opening 50*a* from which the toner 90 is fed out.

The feed-out opening 50*a* is an opening communicating with the inside of the storage portion 50. The feed-out opening 50*a* is formed in a lower part of an end portion of the toner container 5 in its longitudinal direction. The shutter 51 is attached to the storage portion 50 in a state where the feed-out opening 50*a* can be opened and closed by the shutter 51.

The shutter input portion 52 is a portion that receives an external force to open/close the shutter 51. That is, the shutter 51 is opened when, upon receiving the external force, the shutter input portion 52 is displaced in a predetermined opening direction. On the other hand, the shutter 51 is closed when, upon receiving the external force, the shutter input portion 52 is displaced in a predetermined closing direction.

The shutter 51 is provided in order to prevent leakage of the toner 90 from the feed-out opening 50*a* during replacement of the toner container 5.

The toner container 5 further includes an internal rotary body 53 and a rotation input portion 54, wherein the internal rotary body 53 is disposed in the storage portion 50, and the rotation input portion 54 is configured to receive an external force to rotate the internal rotary body 53. The internal rotary body 53 is, for example, a conveyance screw that stirs and conveys the toner 90 in the storage portion 50. The internal rotary body 53 rotates in conjunction with the rotation input portion 54 when the rotation input portion 54 is rotationally driven.

As described below, the attachment portion 6 of the image forming apparatus 10 includes four shutter output portions 6*x* and a main interlocking mechanism 6*y* (see FIG. 4 to FIG. 7). Furthermore, the attachment portion 6 includes four rotation output portions 6*z* (see FIG. 2, FIG. 3, FIG. 6, and FIG. 7). The four shutter output portions 6*x* and the four rotation output portions 6*z* respectively correspond to the four toner containers 5.

Each of the shutter output portions 6*x* is engaged with the shutter input portion 52 of a corresponding toner container 5. Each of the rotation output portions 6*z* is engaged with the rotation input portion 54 of a corresponding toner container 5.

The shutter output portions 6*x* are supported by a support plate 60 in such a way as to be displaced between a closing position and an opening position. The main interlocking mechanism 6*y*, in conjunction with the opening operation and closing operation of the cover portion 100, displaces the shutter output portions 6*x* between the closing position and the opening position.

Figure 4:
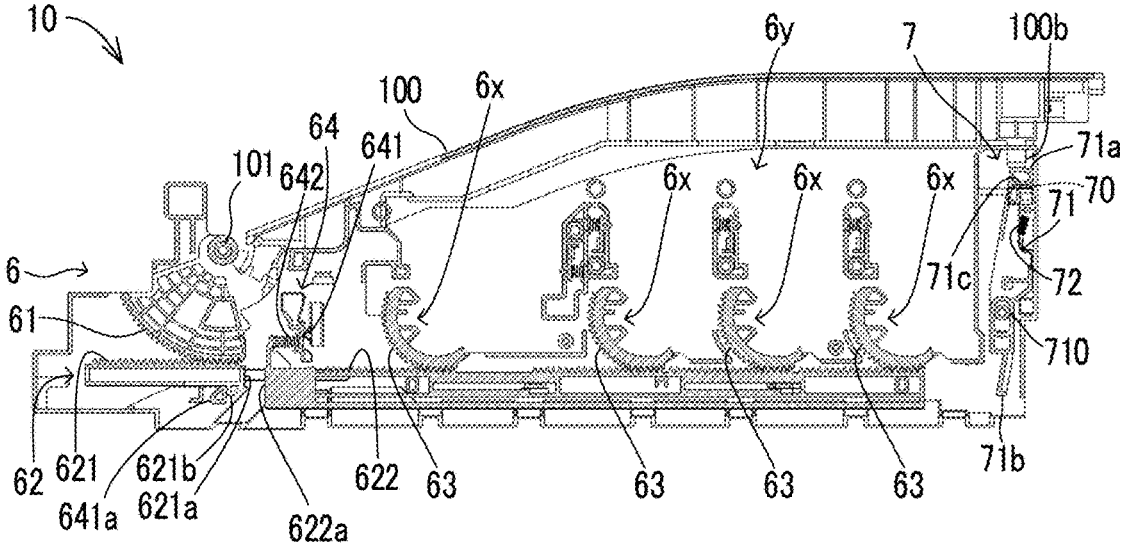
FIG. 4 is a cross-section diagram of a main part of a main interlocking mechanism and a cover state detection mechanism in a state where the cover portion is closed in the image forming apparatus according to the embodiment.
Figure 5:
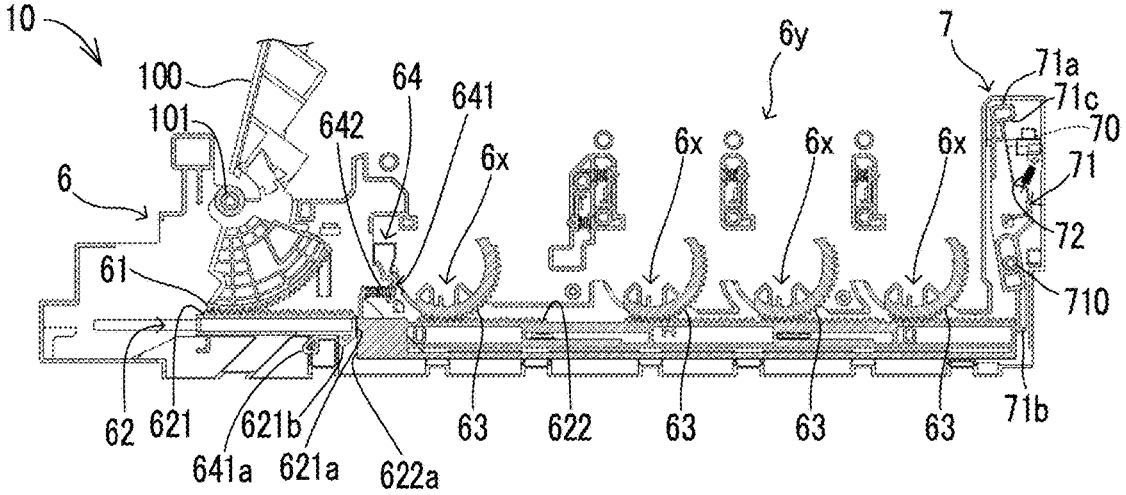
FIG. 5 is a cross-section diagram of the main part of the main interlocking mechanism and the cover state detection mechanism in a state where the cover portion is open in the image forming apparatus according to the embodiment.
Figure 6:
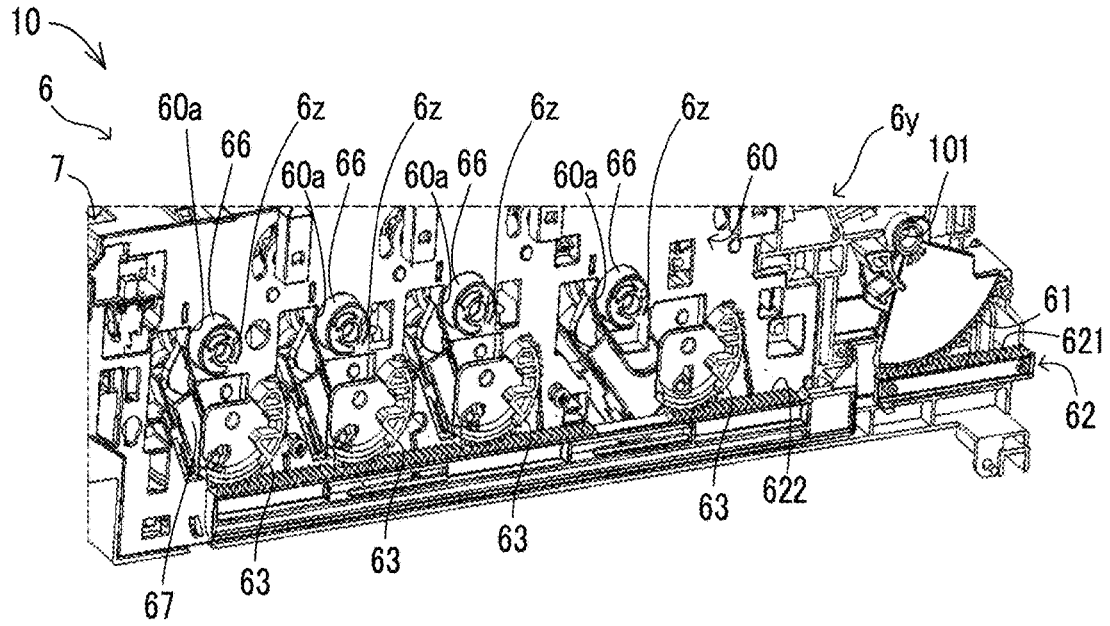
FIG. 6 is a perspective diagram of the main interlocking mechanism when the cover portion is in the closed state in the image forming apparatus according to the embodiment.
Figure 7:
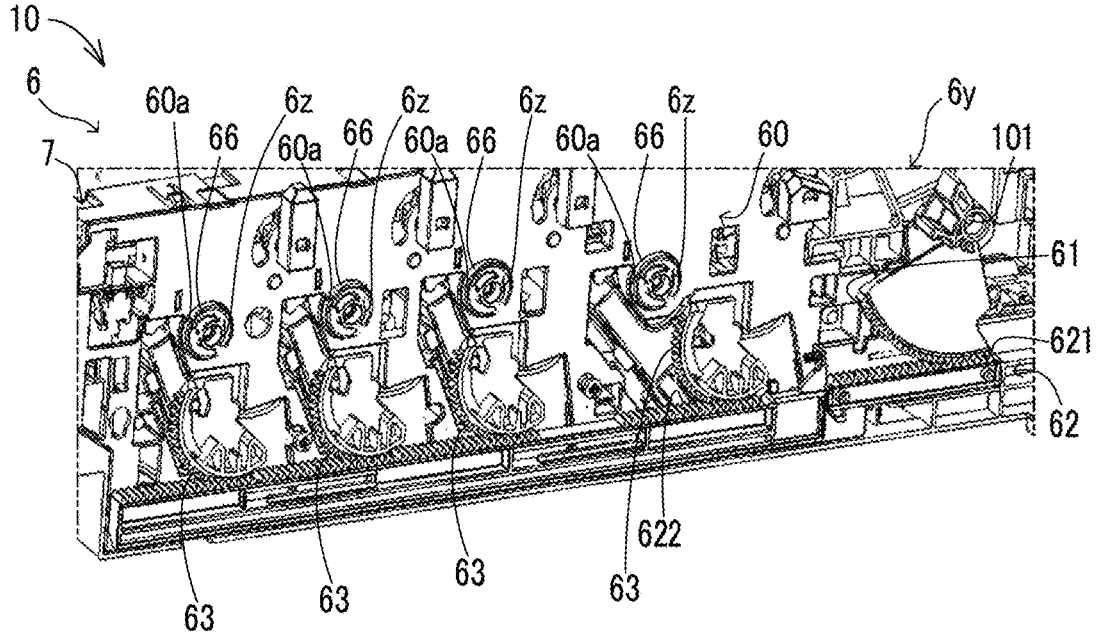
FIG. 7 is a perspective diagram of the main interlocking mechanism when the cover portion is in the open state in the image forming apparatus according to the embodiment.

FIG. 4 and FIG. 6 show a state where the shutter output portions 6*x* are located at the opening position, and FIG. 5 and FIG. 7 show a state where the shutter output portions 6*x* are located at the closing position. When being displaced to the opening position, the shutter output portion 6*x* opens the shutter 51 via the shutter input portion 52. In addition, when being displaced to the closing position, the shutter output portion 6*x* closes the shutter 51 via the shutter input portion 52.

Specifically, the main interlocking mechanism 6*y* displaces the shutter output portions 6*x* to the closing position in conjunction with the opening operation of the cover portion 100. This causes the shutters 51 of the toner containers 5 to be closed.

Furthermore, the main interlocking mechanism 6*y* displaces the shutter output portions 6*x* to the opening position in conjunction with the closing operation of the cover portion 100. This causes the shutters 51 to be opened. The shutter output portions 6*x* and the main interlocking mechanism 6*y* are described in detail below.

The shutter output portions 6*x* and the main interlocking mechanism 6*y* act, without a special operation, to prevent scattering of the toner 90 when the cover portion 100 is opened.

In addition, the attachment portion 6 includes four holders 66. The four holders 66 are rotatably supported by the support plate 60 in a state where the holders 66 are inserted in four circular support holes 60*a* formed in the support plate 60. The rotation output portions 6*z* are rotatably supported by the holders 66, respectively.

In addition, the rotation output portions 6*z* are rotationally driven by a drive device (not shown). The holders 66 are coupled with the main interlocking mechanism 6*y* by a coupling member 67, and are displaced in a direction to approach the toner containers 5 in conjunction with the closing operation of the cover portion 100. At this time, together with the holders 66, the rotation output portions 6*z* are displaced in the direction to approach the toner containers 5 and are engaged with the rotation input portions 54 of the toner containers 5.

That is, in conjunction with the closing operation of the cover portion 100, the rotation output portions 6*z* are displaced to positions where the rotation output portions 6*z* are engaged with the rotation input portions 54 of the toner containers 5. This allows rotational forces to be transmitted from the rotation output portions 6*z* to the internal rotary bodies 53 via the rotation input portions 54. The drive device includes a motor and a gear mechanism that are not shown.

In the present embodiment, the toner container 5 is an example of a unit that is attached to the inside of the apparatus main body 1. The shutter 51 is an example of a driven portion provided in the unit. The shutter input portion 52 is an example of a drive input portion configured to receive an external force that drives the driven portion.

In addition, the shutter output portions 6*x* are an example of a drive output portion that is provided in the apparatus main body 1 in correspondence with the drive input portion of the unit. The opening position of the shutter output portions 6*x* is an example of a predetermined first output position, and the closing position of the shutter output portions 6*x* is an example of a predetermined second output position.

Meanwhile, in a specific case where, for example, the image forming apparatus 10 is transported, it is necessary to prevent the toner 90 from leaking in a state where the cover portion 100 is closed. For example, the feed-out opening 50*a* of the toner container 5 may be closed with a closing member such as adhesive seal.

However, attachment and detachment of the closing member are a troublesome work that requires detaching the toner container 5 from the apparatus main body 1. In addition, when the specific case occurs after the closing member is detached, toner leakage may occur when the closing member is attached again.

In addition, in a case where, as is the case with the present embodiment, the image forming apparatus 10 can perform color printing, the work of attaching and detaching the closing member to/from the plurality of toner containers 5 is more troublesome.

On the other hand, the attachment portion 6 of the image forming apparatus 10 has a structure to, without requiring a troublesome work, prevent leakage of the toner 90 from the toner container 5 in a case where the cover portion 100 closing the main opening 1*a* of the apparatus main body 1 is opened, and in specific cases.

In addition, there are specific cases, such as a case where the image forming apparatus 10 is transported, where it is desirable to release the drive output portion from moving in conjunction with the operation of the cover portion 100.

For example, a mechanism that interlocks the operation of the shutter output portions 6*x* for driving the shutters 51 with the operation of the cover portion 100, may include a mechanism that, in accordance with a predetermined operation, switches between: releasing the interlock between the cover portion 100 and the shutter output portions 6*x*; and enabling the interlock. This makes it possible to transport the image forming apparatus in a state where both the shutters 51 and the cover portion 100 are closed.

On the other hand, as described below, the image forming apparatus 10 includes an object sensor 70 configured to detect the closing state of the cover portion 100 (see FIG. 10). The control device 11 performs an interlock control to prohibit the print process in a case where the object sensor 70 does not detect the closing state of the cover portion 100. The interlock control is performed to prevent the drive portion in the apparatus main body 1 from operating while the drive portion is exposed through the main opening 1*a*. Furthermore, it is possible to prevent the toner 90 from scattering from the main opening 1*a* when the print device 4 operates while the cover portion 100 is open.

However, a regular interlock control does not function in a case where the cover portion 100 is closed in a state where the interlock between the cover portion 100 and the shutter output portions 6*x* is released. In such a case, the print process may be started in a state where the toner containers 5 do not operate normally.

In addition, it is not financially desirable to add a sensor dedicated to detecting the state where the interlock between the cover portion 100 and the shutter output portions 6*x* is released.

The attachment portion 6 of the image forming apparatus 10 has a structure to, without the need to add a sensor, prevent the print process from being started in the state where the interlock between the shutter output portions 6*x* that apply an external force to the shutter input portions 52 of the toner containers 5, and the cover portion 100 is released. The following describes the structure of the image forming apparatus 10.

As shown in FIG. 2 to FIG. 7, the attachment portion 6 includes the support plate 60, the four shutter output portions 6*x* corresponding to the four toner containers 5, and the main interlocking mechanism 6*y*. The attachment portion 6 further includes a temporarily fitting member 65 (see FIG. 9).

The support plate 60 is disposed to stand by a side of a space inside the apparatus main body 1 in which the four toner containers 5 are disposed, and the support plate 60 supports components of the main interlocking mechanism 6*y*.

As described above, the shutter output portions 6*x* are provided in correspondence with the toner containers 5, and are engaged with the shutter input portions 52 of the toner containers 5, respectively. The shutter output portions 6*x* are supported in such a way as to be displaced between the opening position and the closing position.

In the present embodiment, the main interlocking mechanism 6*y* includes a first pinion gear 61, a rack gear set 62, four second pinion gears corresponding to the four toner containers 5, and an auxiliary interlocking mechanism 64.

The rack gear set 62 includes a first rack gear 621 and a second rack gear 622. The auxiliary interlocking mechanism 64 includes an engaging member 641 and an engaging spring 642 that are unitized with the second rack gear 622. The engaging spring 642 applies an elastic force to the engaging member 641. The engaging spring 642 is an example of an engaging elastic member.

The first pinion gear 61 includes gear teeth arranged to form an arc shape. The first pinion gear 61 is integrally provided with the rotary shaft 101 of the cover portion 100 that is rotatably supported. As a result, the first pinion gear 61 swings along an arc around the rotary shaft 101 in conjunction with the rotary shaft 101.

The first rack gear 621 is supported by the support plate 60 in such a way as to be displaceable. The first rack gear 621 meshes with the first pinion gear 61 and is displaced in a straight-line direction in conjunction with the first pinion gear 61.

The second rack gear 622 is disposed along a displacement direction of the first rack gear 621. In other words, the second rack gear 622 is disposed on an extension line of the first rack gear 621 in its longitudinal direction, or disposed in parallel to the first rack gear 621.

Figure 2:
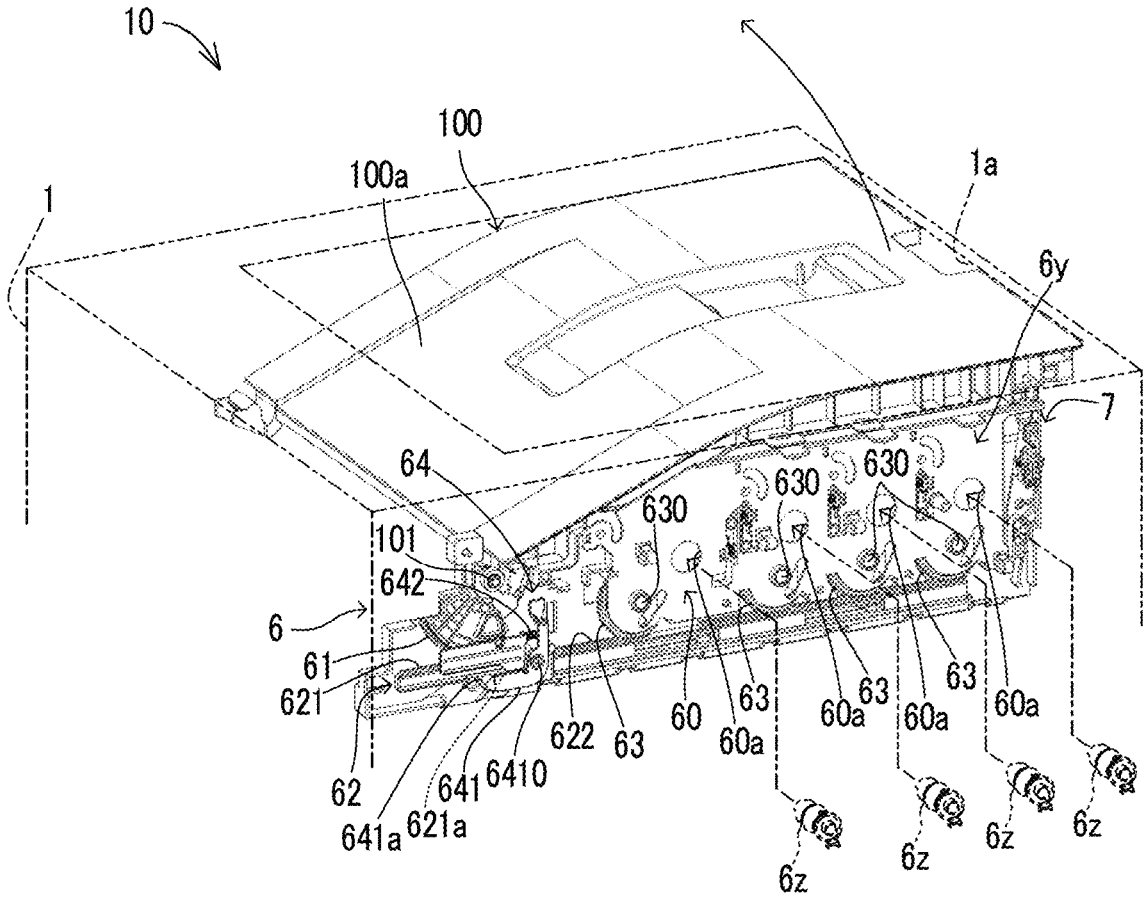
FIG. 2 is a perspective diagram of a cover portion in a closed state and an attachment portion in the image forming apparatus according to the embodiment.
Figure 3:
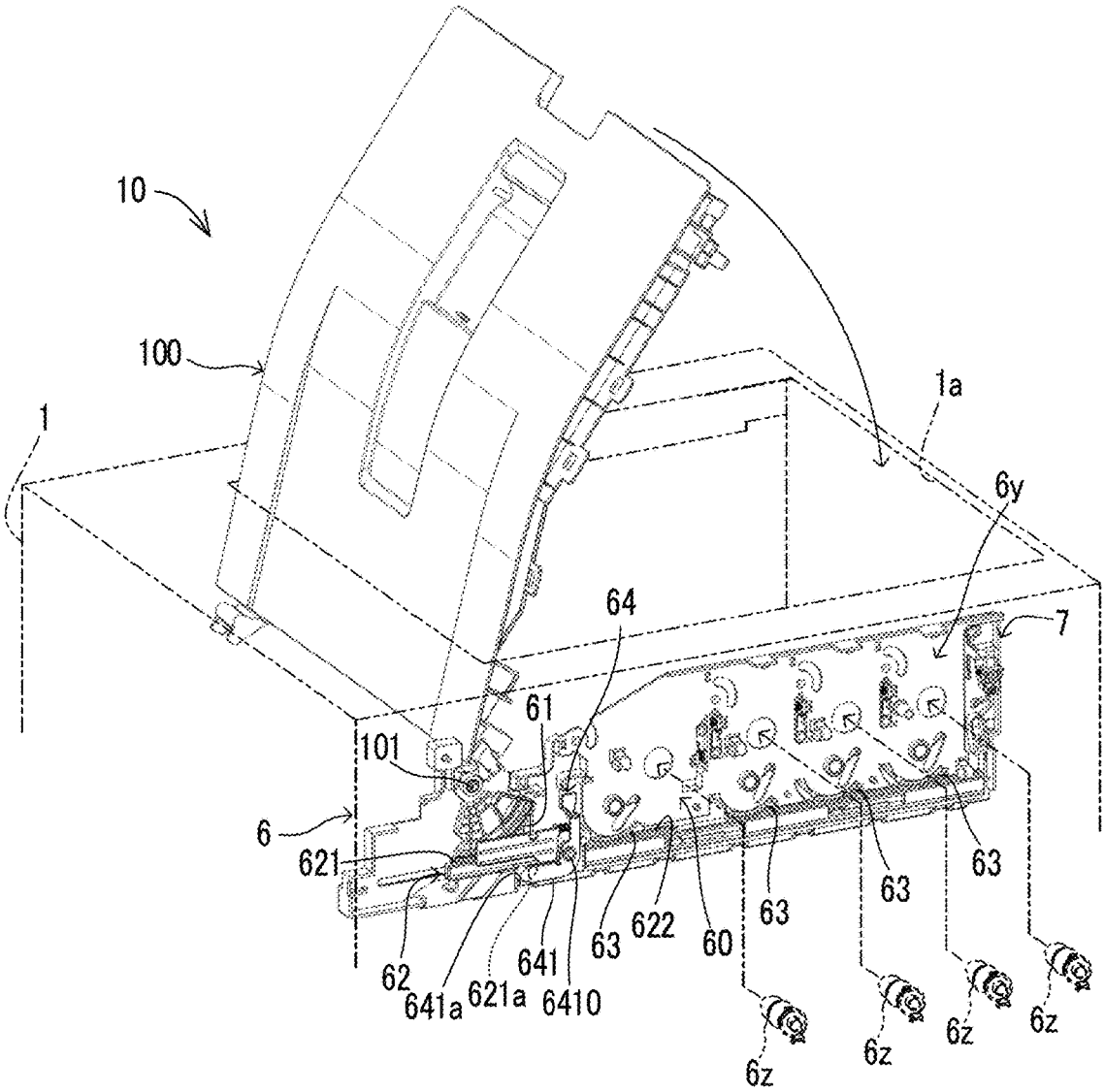
FIG. 3 a perspective diagram of the cover portion in an open state and the attachment portion in the image forming apparatus according to the embodiment.

The second rack gear 622 is supported by the support plate 60 in such a way as to be displaced between a predetermined first relay position and a predetermined second relay position. FIG. 2, FIG. 4, and FIG. 6 show a state where the second rack gear 622 is located at the first relay position, and FIG. 3, FIG. 5, FIG. 7, FIG. 10, and FIG. 11 show a state where the second rack gear 622 is located at the second relay position. The second rack gear 622 is an example of a first displacement member.

Each of the four second pinion gears 63 includes gear teeth arranged to form an arc shape, and is integrally formed with a gear shaft 630 that is rotatably supported by the support plate 60 (see FIG. 2). As a result, each of the second pinion gears 63 can swing along an arc around the gear shaft 630.

The four second pinion gears 63 meshes with one second rack gear 622. Accordingly, the four second pinion gears 63 swing in conjunction with the second rack gear 622.

Each of the second pinion gears 63 is integrally formed with a corresponding one of the shutter output portions 6*x* (see FIG. 4 to FIG. 7). The four second pinion gears 63 move in conjunction with the second rack gear 622 to respectively displace the four shutter output portions 6*x* between the opening position and the closing position.

The engaging member 641 is swingably supported by a swing shaft 6410 supported by the support plate 60. The engaging member 641 includes a projection portion 641*a* configured to be engaged with an engaged portion 621*b* of the first rack gear 621 that moves in conjunction with the closing operation of the cover portion 100.

The engaging member 641 is supported in such a way as to swing between an engaging attitude and a released attitude. In a case where the engaging member 641 is in the engaging attitude, the projection portion 641*a* of the engaging member 641 is engaged with the engaged portion 621*b* when the first rack gear 621 moves in conjunction with the closing operation of the cover portion 100. In a case where the engaging member 641 is in the released attitude, the projection portion 641*a* is held at a position where the projection portion 641*a* is not engaged with the engaged portion 621*b*.

That is, in a case where the engaging member 641 is in the engaging attitude, the projection portion 641*a* is located inside a movement path of the engaged portion 621*b* when the first rack gear 621 is displaced in conjunction with the closing operation of the cover portion 100. On the other hand, in a case where the engaging member 641 is in the released attitude, the projection portion 641*a* is located outside the movement path of the engaged portion 621*b* when the first rack gear 621 is displaced in conjunction with the closing operation of the cover portion 100.

The engaging spring 642 applies an elastic force to the engaging member 641 to hold the engaging member 641 in the engaging attitude. That is, the engaging spring 642 elastically biases the engaging member 641 in a direction from the released attitude to the engaging attitude.

Figure 10:
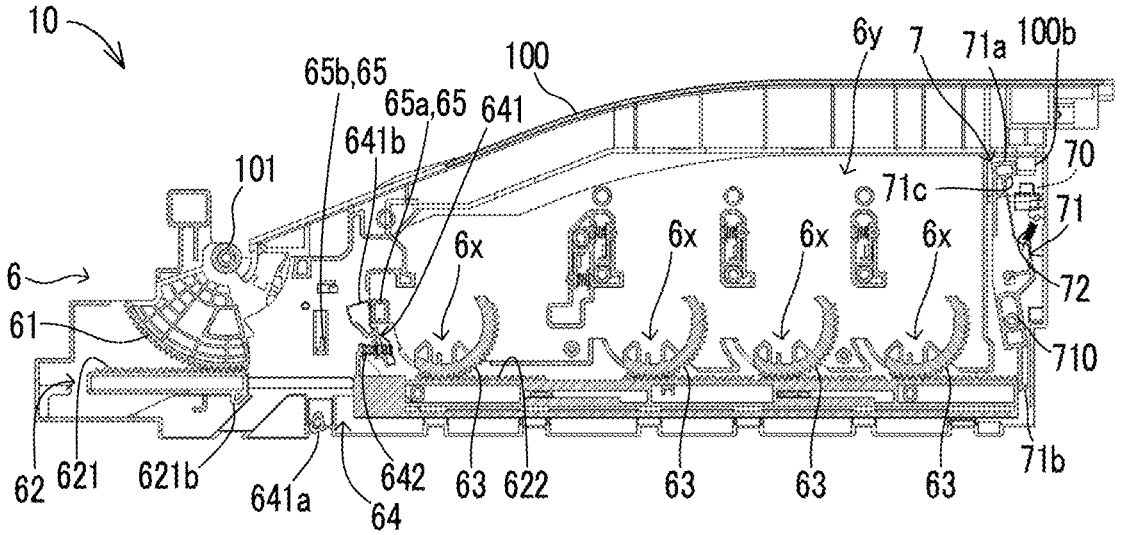
FIG. 10 is a cross-section diagram of the main part of the main interlocking mechanism and the cover state detection mechanism in a state where the cover portion is closed and the temporarily fitting member is attached in the image forming apparatus according to the embodiment.
Figure 11:
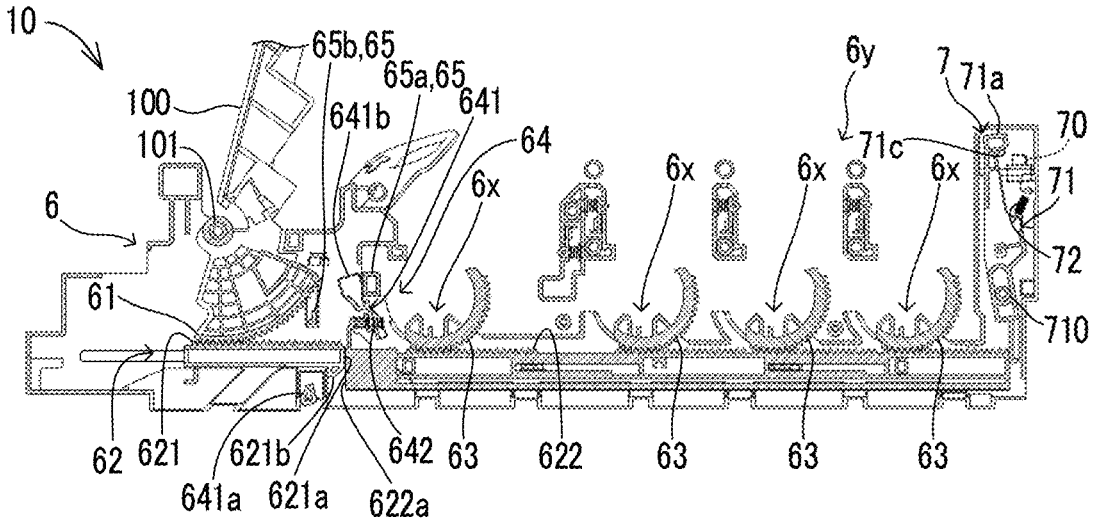
FIG. 11 is a cross-section diagram of the main part of the main interlocking mechanism and the cover state detection mechanism in a state where the cover portion is open and the temporarily fitting member is attached in the image forming apparatus according to the embodiment.

FIG. 2 to FIG. 5 show a state where the engaging member 641 is in the engaging attitude, and FIG. 10 and FIG. 11 show a state where the engaging member 641 is in the released attitude.

When the first rack gear 621 moves in conjunction with the opening operation of the cover portion 100, an end 621*a* of the first rack gear 621 abuts on an end 622*a* of the second rack gear 622, thereby the first rack gear 621 displaces the second rack gear 622 to the second relay position. Furthermore, in conjunction with the displacement of the second rack gear 622 to the second relay position, the shutter output portions 6*x* are displaced from the opening position to the closing position (see FIG. 3, FIG. 5, and FIG. 7). This causes the shutters 51 of the four toner containers 5 to be closed.

In addition, in a case where the engaging member 641 is in the engaging attitude, when the first rack gear 621 moves in conjunction with the closing operation of the cover portion 100, the projection portion 641*a* is engaged with the engaged portion 621*b*, thereby the first rack gear 621 displaces the second rack gear 622 to the first relay position. Furthermore, in conjunction with the displacement of the second rack gear 622 to the first relay position, the shutter output portions 6*x* are displaced from the closing position to the opening position (see FIG. 2, FIG. 4, and FIG. 6). This causes the shutters 51 of the four toner containers 5 to be opened.

The temporarily fitting member 65 is configured to be attached to and detached from the support plate 60. The temporarily fitting member 65 is attached to the support plate 60 only in specific cases where, for example, the image forming apparatus 10 is transported, and the temporarily fitting member 65 is detached from the support plate 60 prior to use of the image forming apparatus 10. For example, the temporarily fitting member 65 is attached to the support plate 60 before shipment of the image forming apparatus 10.

Figure 9:
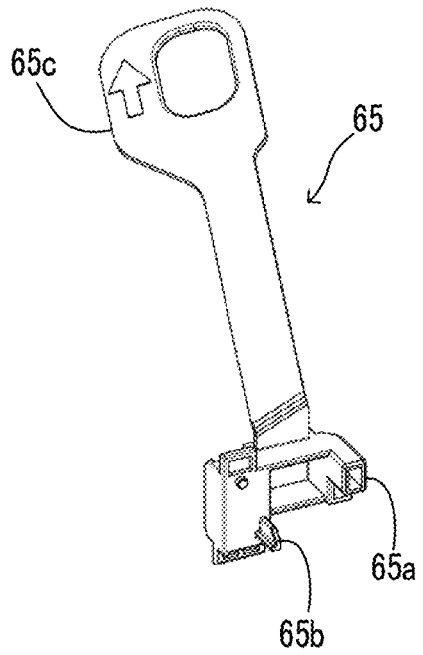
FIG. 9 is a perspective diagram of a temporarily fitting member in the image forming apparatus according to the embodiment.

As shown in FIG. 9, the temporarily fitting member 65 includes a first projection 65*a*, a second projection 65*b*, and a handle portion 65*c*. The first projection 65*a* and the second projection 65*b* are configured to grip a part of the support plate 60.

The first projection 65*a* and the second projection 65*b* are pressed against the support plate 60 at a predetermined position so that they grip a specific part of the support plate 60. This allows the temporarily fitting member 65 to be attached to the support plate 60. In addition, when the handle portion 65*c* is pulled, the temporarily fitting member 65 is removed from the support plate 60.

As shown in FIGS. 10 and 11, in a state where the temporarily fitting member 65 has been attached to the support plate 60, the first projection 65*a* locks the engaging member 641 in the released attitude against the elastic force of the engaging spring 642.

Specifically, a locked portion 641*b* of the engaging member 641 is locked by the first projection 65*a* of the temporarily fitting member 65 attached to the support plate 60. This causes the engaging member 641 to be held in the released attitude.

On the other hand, when the temporarily fitting member 65 is removed from the support plate 60, the lock of the engaging member 641 by the first projection 65*a* is released. In this case, the engaging member 641 is held in the engaging attitude by the elastic force of the engaging spring 642.

As shown in FIG. 10, when the cover portion 100 is closed in a state where the engaging member 641 is held in the released attitude, the first rack gear 621 moves in conjunction with the closing operation of the cover portion 100, but the second rack gear 622 and the four second pinion gears 63 do not move in conjunction therewith. This allows the four shutter output portions 6*x* to be held at the closing position, and the shutters 51 of the four toner containers 5 to be held in the closed state.

As shown in FIG. 5 and FIG. 11, in a case where the cover portion 100 is open, the end 621*a* of the first rack gear 621 that moves in conjunction with the closing operation of the cover portion 100, abuts on the end 622*a* of the second rack gear 622, regardless of the attitude of the engaging member 641. This allows the four shutter output portions 6*x* to be held at the closing position, and the shutters 51 of the four toner containers 5 are held in the closed state.

As described above, in a case where the temporarily fitting member 65 has not been attached, the auxiliary interlocking mechanism 64 causes the second rack gear 622 to move in conjunction with a displacement of the first rack gear 621 interlocked with the closing operation of the cover portion 100.

In addition, when the temporarily fitting member 65 has been attached, the auxiliary interlocking mechanism 64 releases the second rack gear 622 from moving in conjunction with the displacement of the first rack gear 621 interlocked with the closing operation of the cover portion 100.

In the main interlocking mechanism 6*y*, the first pinion gear 61, the rack gear set 62, the auxiliary interlocking mechanism 64, and the temporarily fitting member 65 constitute a first interlocking mechanism. The first interlocking mechanism causes the second rack gear 622 to be displaced to the second relay position in conjunction with the opening operation of the cover portion 100, and causes the second rack gear 622 to be displaced to the first relay position in conjunction with the closing operation of the cover portion 100.

In addition, in the main interlocking mechanism 6*y*, the second pinion gears 63 constitute a second interlocking mechanism. The second interlocking mechanism causes the shutter output portions 6*x* to be displaced to the closing position in conjunction with the displacement of the second rack gear 622 to the second relay position, and causes the shutter output portions 6*x* to be displaced to the opening position in conjunction with the displacement of the second rack gear 622 to the first relay position.

In addition, in the main interlocking mechanism 6*y*, the auxiliary interlocking mechanism 64 and the temporarily fitting member 65 are an example of a switch mechanism that switches the interlocking state of the main interlocking mechanism 6*y*. The switch mechanism is configured to, in accordance with a predetermined release operation, release the shutter output portions 6*x* from moving in conjunction with the closing operation of the cover portion 100, and in accordance with a predetermined enabling operation, enable the shutter output portions 6*x* to move in conjunction with the closing operation of the cover portion 100.

In the main interlocking mechanism 6*y*, the release operation is an operation to attach the temporarily fitting member 65 to the support plate 60 of the attachment portion 6. In addition, the enabling operation is an operation to remove the temporarily fitting member 65 from the support plate 60.

As a result, in a case where the temporarily fitting member 65 has not been attached, the main interlocking mechanism 6*y* causes the shutter output portions 6*x* to move in conjunction with the opening/closing operation of the cover portion 100 such that the shutter output portions 6*x* are displaced to the opening position when the cover portion 100 is closed, and the shutter output portions 6*x* are displaced to the closing position when the cover portion 100 is opened.

On the other hand, in a case where the temporarily fitting member 65 has been attached, the main interlocking mechanism 6*y* releases the shutter output portions 6*x* from moving in conjunction with the opening/closing operation of the cover portion 100 such that the shutter output portions 6*x* are held at the closing position.

As a result, in specific cases where, for example, the image forming apparatus 10 is transported, it is possible to prevent the leakage of the toner 90 while closing the cover portion 100 only by attaching the temporarily fitting member 65 to the support plate 60. The attachment of the temporarily fitting member 65 is an extremely simple work.

In addition, when the cover portion 100 is opened, the shutter 51 of the toner container 5 is closed without a special operation, and leakage of the toner 90 is prevented.

It is noted that in a case where the feed-out opening 50*a* of the toner container 5 is closed with a closing member such as adhesive seal, attachment and detachment of the closing member are a troublesome work that requires detaching the toner container 5 from the apparatus main body 1. In addition, when the specific case occurs after the closing member is detached, toner leakage may occur when the closing member is attached again.

In addition, in a case where, as is the case with the present embodiment, the image forming apparatus 10 can perform color printing, the work of attaching and detaching the closing member to/from the plurality of toner containers 5 is more troublesome.

On the other hand, as described above, the image forming apparatus 10 has a structure to, without requiring a troublesome work, prevent leakage of the toner 90 from the toner container 5 in specific cases.

In addition, the image forming apparatus 10 further includes a cover state detection mechanism 7 (see FIG. 4, FIG. 5, FIG. 10, FIG. 11). The cover state detection mechanism 7 is configured to detect whether the cover portion 100 is in the open state or the closed state.

The cover state detection mechanism 7 includes an object sensor 70, a detection target member 71, and a return spring 72. The return spring 72 is an example of a return elastic member.

The object sensor 70 is disposed in the apparatus main body 1 and configured to detect an object that is located at a predetermined detection position. For example, a contact-type sensor, such as a limit switch, may be adopted as the object sensor 70. In addition, a non-contact type sensor, such as a photo sensor, may be adopted as the object sensor 70.

The detection target member 71 is displaceably supported in the apparatus main body 1. Specifically, the detection target member 71 is supported by a support shaft 710 fixed to the support plate 60 in such a way as to be displaced vertically and swing around the support shaft 710.

The detection target member 71 includes a first contact portion 71*a*, a second contact portion 71*b*, and a detected portion 71*c*. In the present embodiment, an upper end portion of the detection target member 71 that is formed to be vertically long is the first contact portion 71*a*, and a lower end portion of the detection target member 71 is the second contact portion 71*b*.

The first contact portion 71*a* is configured to abut on an abutting portion 100*b* formed on the cover portion 100 when the cover portion 100 is closed (see FIG. 4, FIG. 10). The abutting portion 100*b* is formed to project from an inner surface of the cover portion 100.

The second contact portion 71*b* is configured to abut on the second rack gear 622 interlocking with the cover portion 100 when the cover portion 100 is opened (see FIG. 5, FIG. 11).

The detected portion 71*c* is configured to proceed to the detection position. The object sensor 70 detects the detected portion 71*c* that has proceeded to the detection position.

Figure 12:
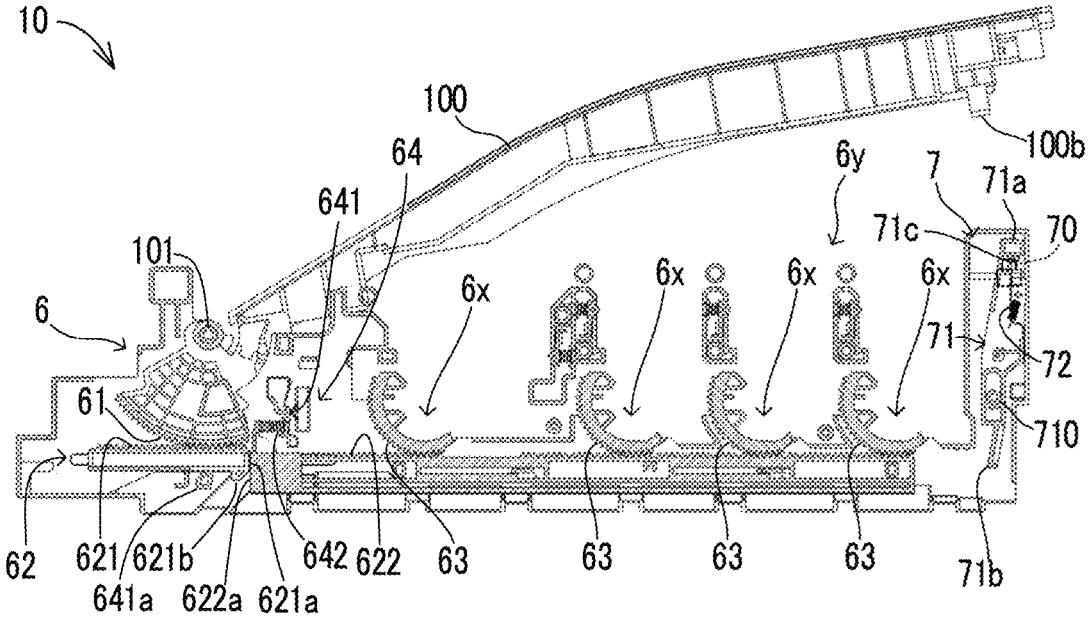
FIG. 12 is a cross-section diagram of the main part of the main interlocking mechanism and the cover state detection mechanism in a state where the cover portion is half open in the image forming apparatus according to the embodiment.

The detection target member 71 is configured to be displaced among predetermined standard position, actuation position, and retreat position. FIG. 12 shows a state where the detection target member 71 is located at the standard position, FIG. 4 shows a state where the detection target member 71 is located at the actuation position, and FIG. 5, FIG. 10, and FIG. 11 show a state where the detection target member 71 is located at the retreat position. The detection target member 71 is an example of a second displacement member.

In the state where the detection target member 71 is located at the standard position, the first contact portion 71*a* is located at a position where the first contact portion 71*a* is in contact with the abutting portion 100*b* of the cover portion 100, and the detected portion 71*c* is located outside the detection position (see FIG. 12).

In the state where the detection target member 71 is located at the actuation position, the detected portion 71*c* is located at the detection position (see FIG. 4).

In the state where the detection target member 71 is located at the retreat position, the first contact portion 71*a* is located at a position where the first contact portion 71*a* is not in contact with the abutting portion 100*b* of the cover portion 100, and the detected portion 71*c* is located outside the detection position (see FIG. 5, FIG. 10, FIG. 11).

The return spring 72 applies an elastic force to the detection target member 71, thereby holding the detection target member 71 at the standard position. With this configuration, the detection target member 71 is held at the standard position by the elastic force of the return spring 72 when the detection target member 71 is in contact with neither the abutting portion 100*b* nor the second rack gear 622 (see FIG. 12).

When the cover portion 100 is closed in a state where the detection target member 71 is located at the standard position, the abutting portion 100*b* of the cover portion 100 abuts on the first contact portion 71*a*, and thereby displaces the detection target member 71 from the standard position to the actuation position (see FIG. 4).

When the detection target member 71 is displaced to the actuation position, the detected portion 71*c* proceeds to the detection position, and the object sensor 70 detects the detected portion 71*c*. Upon detection of the detected portion 71*c*, the object sensor 70 detects that the cover portion 100 is closed.

The control device 11 permits an execution of the print process on condition that the object sensor 70 has detected an object. Here, the object detected by the object sensor 70 is the detected portion 71*c*.

That is, the control device 11 permits an execution of the print process by the print device 4 on condition that the cover portion 100 is closed. In a case where the temporarily fitting member 65 has not been attached to the support plate 60 and the cover portion 100 is closed, the shutters 51 of the toner containers 5 are open.

On the other hand, the control device 11 prohibits the execution of the print process in a case where the object sensor 70 does not detect an object. That is, in a case where the cover portion 100 is open, upon receiving a request to execute the print process, the control device 11 does not allow the print device 4 to execute the print process. It is noted that the control on the print process by the control device 11 is executed by the processor 11*x*.

In a case where the temporarily fitting member 65 has not been attached to the support plate 60 and the cover portion 100 is open, the shutters 51 of the toner containers 5 are closed. That is, the control device 11 does not allow the print device 4 to execute the print process when the shutters 51 of the toner containers 5 are closed.

When the second rack gear 622 moves in conjunction with the opening operation of the cover portion 100 in a state where the detection target member 71 is located at the standard position, the second rack gear 622 abuts on the second contact portion 71*b* and thereby displaces the detection target member 71 from the standard position to the retreat position (see FIG. 5).

In addition, in a case where the temporarily fitting member 65 has been attached to the support plate 60, the second rack gear 622 does not move in conjunction with the opening/closing operation of the cover portion 100. As a result, the second rack gear 622 is held at a position where it abuts on the second contact portion 71*b*, regardless of the state of the cover portion 100 (see FIG. 10, FIG. 11).

That is, in a case where the temporarily fitting member 65 has been attached to the support plate 60, the state where the second rack gear 622 abuts on the second contact portion 71*b* is maintained, and the detection target member 71 is held at the retreat position (see FIG. 10, FIG. 11).

As a result, in a case where the temporarily fitting member 65 has been attached to the support plate 60, if the cover portion 100 is closed, the abutting portion 100*b* does not abut on the first contact portion 71*a*, and the object sensor 70 does not detect the detected portion 71*c*.

That is, in a case where the temporarily fitting member 65 has been attached to the support plate 60, the state where the control device 11 prohibits an execution of the print process is maintained regardless of the opening/closing of the cover portion 100. This makes it possible to prevent an execution of the print process while the interlock between the cover portion 100 and the shutter output portions 6*x* is released. In the present embodiment, the print process is prohibited from being started while the shutters 51 of the toner containers 5 are closed.

It is noted that in a case where the image forming apparatus 10 is a monochrome image forming apparatus, the attachment portion 6 is configured such that only one toner container 5 is attached to the attachment portion 6. In this case, the attachment portion 6 includes one shutter output portion 6*x*, one second pinion gear 63, one rotation output portion 6*z*, and one holder 66.

First Application Example

Next, a first application example of the image forming apparatus 10 is described.

In the image forming apparatus 10 of the present application example, the temporarily fitting member 65 of the main interlocking mechanism 6*y* is replaced with a switch attached to the support plate 60. For example, the switch may be a slide switch. In this case, the switch is configured to be slide-displaced between a position to lock the locked portion 641*b* of the engaging member 641, and a position separated from the engaging member 641.

When the switch is turned ON, the switch causes the engaging member 641 to be locked to the released attitude against the elastic force of the engaging spring 642. In addition, when the switch is turned OFF, the switch is separated from the engaging member 641.

In the present application example, the auxiliary interlocking mechanism 64 and the switch are an example of the switch mechanism. In addition, the operation to turn ON the switch is an example of the release operation, and the operation to turn OFF the switch is an example of the enabling operation.

Second Application Example

Next, a second application example of the image forming apparatus 10 is described.

In the present application example, the main interlocking mechanism 6*y* is a mechanism configured to cause a drive output portion other than the shutter output portions 6*x* to move in conjunction with the cover portion 100. In the present application example, the drive output portion may be the rotation output portions 6*z* that applies an external force to the rotation input portions 54 of the toner containers 5. In this case, the rotation input portions 54 are an example of the drive input portion.

In addition, in the present application example, the main interlocking mechanism 6*y* may be a mechanism configured to cause the drive output portion corresponding to a drive input portion of a process unit to move in conjunction with the cover portion 100. The process unit includes either or both of the photoconductor 41 and a developing roller 430. The drive input portion of the process unit is configured to receive an external force that drives either or both of the photoconductor 41 and the developing roller 430.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body in which an attachment portion is provided and a main opening communicating with the attachment portion is formed, wherein one or more units are attached to the attachment portion, and each of the units includes a driven portion and a drive input portion, the drive input portion receiving an external force to drive the driven portion;

a cover portion supported by the apparatus main body and configured to open and close the main opening;

one or more drive output portions provided in the apparatus main body in correspondence with the drive input portions of the units, and supported in such a way as to be displaced between a predetermined first output position and a predetermined second output position;

a first interlocking mechanism provided in the apparatus main body and including a first displacement member supported in such a way as to be displaced between a predetermined first relay position and a predetermined second relay position, wherein the first interlocking mechanism causes the first displacement member to be displaced to the second relay position in conjunction with an opening operation of the cover portion, and causes the first displacement member to be displaced to the first relay position in conjunction with a closing operation of the cover portion;

a second interlocking mechanism configured to cause the drive output portions to be displaced to the first output position in conjunction with a displacement of the first displacement member to the second relay position, and cause the drive output portions to be displaced to the second output position in conjunction with a displacement of the first displacement member to the first relay position;

an object sensor disposed in the apparatus main body and configured to detect an object that is located at a predetermined detection position;

a second displacement member including a first contact portion, a second contact portion, and a detected portion and supported in such a way as to be displaced among a standard position, an actuation position, and a retreat position in the apparatus main body, the first contact portion abutting on an abutting portion formed on the cover portion when the cover portion is closed, the second contact portion abutting on the first displacement member displaced to the second relay position, the detected portion configured to proceed to the detection position;

a return elastic member configured to apply an elastic force to the second displacement member to hold the second displacement member at the standard position; and a control device configured to permit an execution of a print process on condition that the object sensor detects the object, and prohibit the execution of the print process when the object sensor does not detect the object, wherein the first interlocking mechanism includes a switch mechanism configured to, in accordance with a predetermined release operation, release the first displacement member from moving in conjunction with the closing operation of the cover portion, and in accordance with a predetermined enabling operation, enable the first displacement member to move in conjunction with the closing operation of the cover portion, in a state where the second displacement member is located at the standard position, the first contact portion is located at a position where the first contact portion is in contact with the abutting portion of the cover portion, and the detected portion is located outside the detection position, in a state where the second displacement member is located at the actuation position, the detected portion is located at the detection position, in a state where the second displacement member is located at the retreat position, the first contact portion is located at a position where the first contact portion is not in contact with the abutting portion of the cover portion, and the detected portion is located outside the detection position, when the cover portion is closed in the state where the second displacement member is located at the standard position, the abutting portion of the cover portion abuts on the first contact portion, and thereby displaces the second displacement member from the standard position to the actuation position, and when the first displacement member is displaced to the second relay position in the state where the second displacement member is located at the standard position, the first displacement member abuts on the second contact portion and thereby displaces the second displacement member from the standard position to the retreat position.

2. The image forming apparatus according to claim 1, wherein the first interlocking mechanism includes:

a first pinion gear configured to move in conjunction with a rotary shaft of the cover portion that is rotatably supported;

a first rack gear configured to mesh with the first pinion gear and be displaced in a straight-line direction in conjunction with the first pinion gear; and a second rack gear disposed along a displacement direction of the first rack gear, the second interlocking mechanism includes:

one or more second pinion gears configured to mesh with the second rack gear and move in conjunction with the second rack gear to displace the one or more drive output portions, the second rack gear is the first displacement member, the switch mechanism includes:

a temporarily fitting member configured to be attached to and detached from the attachment portion; and an auxiliary interlocking mechanism configured to, in a case where the temporarily fitting member has not been attached, cause the second rack gear to move in conjunction with a displacement of the first rack gear interlocked with the closing operation of the cover portion, and, in a case where the temporarily fitting member has been attached, release the second rack gear from moving in conjunction with the displacement of the first rack gear interlocked with the closing operation of the cover portion, the release operation is an operation to attach the temporarily fitting member to the attachment portion, and the enabling operation is an operation to remove the temporarily fitting member from the attachment portion.

3. The image forming apparatus according to claim 2, wherein in a case where the attachment portion includes a plurality of second pinion gears, the second rack gear meshes with the plurality of second pinion gears.

4. The image forming apparatus according to claim 2, wherein the auxiliary interlocking mechanism includes an engaging member and an engaging elastic member, the engaging member being unitized with the second rack gear, the engaging elastic member configured to apply an elastic force to the engaging member, the engaging member is supported in such a way as to swing between an engaging attitude and a released attitude, wherein in a case where the engaging member is in the engaging attitude, the engaging member is engaged with the first rack gear that moves in conjunction with the closing operation of the cover portion, and in a case where the engaging member is in the released attitude, the engaging member is not engaged with the first rack gear, the engaging elastic member applies an elastic force to the engaging member to hold the engaging member in the engaging attitude, in a state where the temporarily fitting member has been attached, the temporarily fitting member locks the engaging member in the released attitude against the elastic force of the engaging elastic member, and when the temporarily fitting member is removed, a lock of the engaging member is released.

5. The image forming apparatus according to claim 1, wherein each of the units includes a storage portion and the drive input portion, the storage portion storing granular developer, the drive input portion receiving the external force to open and close a shutter closing a feed-out opening from which the developer is fed out, and each of the drive output portions, when engaged with the drive input portion of a corresponding one of the units and displaced to the first output position, opens the shutter via the drive input portion, and when engaged with the drive input portion and displaced to the second output position, closes the shutter via the drive input portion.

* * * * *